US009351065B2

(12) United States Patent
He et al.

(10) Patent No.: US 9,351,065 B2
(45) Date of Patent: May 24, 2016

(54) LOUDSPEAKER ENCLOSURE SYSTEM HAVING DETACHABLE WIRELESS HEADPHONES AND CONTROL METHOD THEREOF

(71) Applicant: NINGBO FREEWINGS TECHNOLOGIES CO., LTD., Ningbo (CN)

(72) Inventors: Xiaoying He, Ningbo (CN); Wenmin Zhang, Ningbo (CN); Kelong Cao, Ningbo (CN); Fujun Yi, Ningbo (CN); Kaizhong Shen, Ningbo (CN)

(73) Assignee: Ningbo Freewings Technologies Co., Ltd., Ningbo (CN)

( * ) Notice: Subject to any disclaimer, the term of this patent is extended or adjusted under 35 U.S.C. 154(b) by 81 days.

(21) Appl. No.: 14/328,072

(22) Filed: Jul. 10, 2014

(65) Prior Publication Data

US 2015/0215695 A1 Jul. 30, 2015

(30) Foreign Application Priority Data

Jan. 27, 2014 (CN) ..... 2014 1 0039302

(51) Int. Cl.
*H04R 1/10* (2006.01)

(52) U.S. Cl.
CPC ..... *H04R 1/1091* (2013.01); *H04R 1/10* (2013.01); *H04R 1/1025* (2013.01); *H04R 2201/109* (2013.01); *H04R 2420/07* (2013.01)

(58) Field of Classification Search
None
See application file for complete search history.

(56) References Cited

U.S. PATENT DOCUMENTS

2004/0185821 A1* 9/2004 Yuasa ..... H04W 52/0277 455/343.5
2007/0243909 A1* 10/2007 Huang ..... H04B 1/385 455/569.1
2008/0070516 A1* 3/2008 Lee ..... H04R 5/04 455/90.1
2008/0261527 A1* 10/2008 Chen ..... H04M 1/04 455/41.2
2008/0268912 A1* 10/2008 Wang ..... H04M 1/6066 381/104
2015/0146878 A1* 5/2015 Meredith ..... G10K 11/178 381/71.6

* cited by examiner

*Primary Examiner* — Thang Tran
(74) *Attorney, Agent, or Firm* — McNees Wallace & Nurick LLC

(57) ABSTRACT

The present invention discloses a loudspeaker enclosure system having detachable wireless headphones, including: a loudspeaker enclosure and wireless headphones, where the loudspeaker enclosure and the wireless headphones may be used separately; also, the wireless headphones are arranged with a first connector, and the loudspeaker enclosure is arranged with a second connector. The first connector and the second connector may be fit into an electrical plug connection to use the wireless headphones and the loudspeaker enclosure in combination, so that the wireless headphones receive wireless audio signals and output the wireless audio signals to the loudspeaker enclosure to enable the loudspeaker enclosure to play music. The present invention can receive wireless audio signals and play music anywhere with the wireless headphones, and can also share music with others by playing music with the loudspeaker enclosure when necessary.

6 Claims, 3 Drawing Sheets

LOUDSPEAKER ENCLOSURE SYSTEM HAVING DETACHABLE WIRELESS HEADPHONES AND CONTROL METHOD THEREOF

BACKGROUND

1. Technical Field

The present invention relates to a loudspeaker enclosure system having detachable wireless headphones and a control method thereof.

2. Related Art

Loudspeaker enclosures and wireless headphones have been widely used by people at present. A loudspeaker enclosure is generally arranged with an audio input interface for data cables to be plugged in; when the loudspeaker enclosure is used, the audio input interface and an audio source output apparatus are connected through the data cable to receive audio signals to play music with loudspeakers. The wireless headphones may receive wireless audio signals from the audio source output apparatus with a wireless receiving module to play music with a wireless headphone speaker.

When the foregoing loudspeaker enclosure is used, only a data cable can be used to receive audio signals from the audio source output apparatus, that is, only wired audio input manner can be used for music listening, while a wireless audio input manner cannot be used for music listening. Also, the loudspeaker enclosure is not portable for music playing and inconvenient to use, while the foregoing wireless headphones can only be used for a single person to listen to music and cannot be used to share music with others.

SUMMARY

The technical problem to be solved in the present invention is to provide a loudspeaker enclosure system having detachable wireless headphones that can receive wireless audio signals and play music anywhere with the wireless headphones, and can share music with others by playing music with the loudspeaker enclosure when necessary.

To solve the foregoing technical problem, the present invention provides a loudspeaker enclosure system having detachable wireless headphones, including a loudspeaker enclosure, where the loudspeaker enclosure includes an audio input interface, a second audio power amplifier, and loudspeakers; and further including wireless headphones, where the wireless headphones include a wireless receiving module, a first controller, a first audio power amplifier, a first audio switch, a wireless headphone speaker, a filter and voltage regulating circuit, and a first connector, where the wireless receiving module, the first controller, the first audio power amplifier, and the first audio switch are electrically connected in sequence, two audio signal output terminals of the first audio switch are electrically connected to the loudspeakers and the first connector respectively, and the first connector is electrically connected to the first controller through the filter and voltage regulating circuit; and the loudspeaker enclosure further includes a second controller, a second audio switch, and a second connector, where the second audio switch, the second audio power amplifier, and the loudspeakers are electrically connected in sequence, two audio signal input terminals of the second audio switch are electrically connected to the audio input interface and the second connector respectively, the second connector is electrically connected to the second audio switch through the second controller, and the first connector and the second connector are detachable electrical matching plug and receptacle connections.

As an improvement, the wireless headphones further include a charging circuit and a rechargeable battery, a current output terminal of the first controller is electrically connected to the charging circuit and the rechargeable battery in sequence, and the loudspeaker enclosure further includes a power supply module that is electrically connected to the second connector and the second audio power amplifier separately.

Present invention further provides a control method of the loudspeaker enclosure system having detachable wireless headphones, where when the first connector and the second connector are plug-connected, voltage of a pin of the first connector is output to the first controller through the filter and voltage regulating circuit, and after the voltage output to the first controller through the filter and voltage regulating circuit is stabilized at a certain voltage value and lasts at least 100 milliseconds, the first controller controls the audio signal output terminal of the first audio switch to switch to the first connector.

When the first connector and the second connector are plug-connected, the second controller checks the voltage of a grounding contact of the first connector, and after it is detected that the voltage of the grounding contact of the first connector is stabilized at zero volt and lasts at least 100 milliseconds, the second controller sends a control signal to the second audio switch, and the audio signal input terminal of the second audio switch is switched to the second connector.

When the first connector and the second connector are plug-connected, the voltage of a pin of the first connector is output to the first controller through the filter and voltage regulating circuit, and after the voltage output to the first controller through the filter and voltage regulating circuit is stabilized at a certain voltage value and lasts at least 100 milliseconds, the first controller outputs current to the charging circuit to charge the rechargeable battery.

After the foregoing structure and method are used, compared with the prior art, the present invention has the following advantages:

The present invention has three working modes: 1. The wireless headphones are used separately, and in this case, the wireless headphones may receive wireless audio signals and play music with the wireless headphone speakers; in this case, the wireless headphones implement a function of receiving wireless audio signals and playing music anywhere. 2. The loudspeaker enclosure is used separately, and in this case, the loudspeaker enclosure may play music with the wired audio input. 3. The wireless headphones and the loudspeaker enclosure are used in combination, and in this case, the first connector and the second connector fit in an electrical plug and receptacle connection, so that wireless audio signals received by the wireless headphones is transmitted to the loudspeaker enclosure and played with the loudspeakers, thereby implementing a function of sharing music with others when there is crowd. That is, the present invention can both receive wireless audio signals and play music anywhere with the wireless headphones and share music with others by playing music with the loudspeaker enclosure when necessary, which ensures versatility and convenient use; also, the loudspeaker enclosure can further be used as a base for placing the wireless headphones, making it more convenient to place the wireless headphones.

In addition, when the first connector and the second connector are plug-connected, the audio signal output terminal of the first audio switch is switched to the first connector only after the voltage of the pin of the first connector is stabilized at a voltage value and the voltage value lasts at least 100 milliseconds. After the voltage of the pin of the first connector is stabilized at a certain voltage value and the voltage value lasts at least 100 milliseconds, it indicates that the first connector and the second connector already have stable contact. In this way, it can avoid that noise is generated because the audio signal output terminal of the first audio switch is switched before the first connector and the second connector have stable contact.

In addition, when the first connector and the second connector are plug-connected, the signal input terminal of the second audio switch is switched to the second connector only after the voltage of the grounding contact of the first connector is stabilized at zero volt and lasts at least 100 milliseconds. After the voltage of the grounding contact of the first connector is stabilized at zero volt and lasts at least 100 milliseconds, it indicates that the first connector and the second connector already have stable contact. In this way, it can avoid that noise is generated because the audio signal input terminal of the second audio switch is switched before the first connector and the second connector have stable contact.

In addition, after the wireless headphones are placed on the loudspeaker enclosure, the power supply module of the loudspeaker enclosure may charge the rechargeable battery of the wireless headphones, making the charging of the wireless headphones more convenient, and when the first connector and the second connector are plug-connected, the rechargeable battery is charged only after the voltage of the pin of the first connector is stabilized at a certain voltage value and lasts at least 100 milliseconds. After the voltage of the pin of the first connector is stabilized at a certain voltage value and lasts at least 100 milliseconds, it indicates that the first connector and the second connector already have stable contact. In this way, it can avoid that the first controller shuts down due to jumping of the output voltage of the first controller because the rechargeable battery is charged before the first connector and the second connector have stable contact, resulting in a shutdown of the wireless headphones.

1, Loudspeaker enclosure; 101, Second connector; 102, Second controller; 103, Second audio switch; 104, Audio input interface; 105, Power supply module; 106, Second audio power amplifier; 107, Second left speaker; 108, Second right speaker; 2, Wireless headphones; 201, First connector; 202, Wireless receiving module; 203, First controller; 204, First audio power amplifier; 205, First audio switch; 206, Filter and voltage regulating circuit; 207, Charging circuit; 208, Rechargeable battery; 209, First left speaker; and 210, First right speaker.

DETAILED DESCRIPTION

The present invention is further illustrated in detail with reference to accompanying drawings and specific implementation embodiments.

Figure 1:
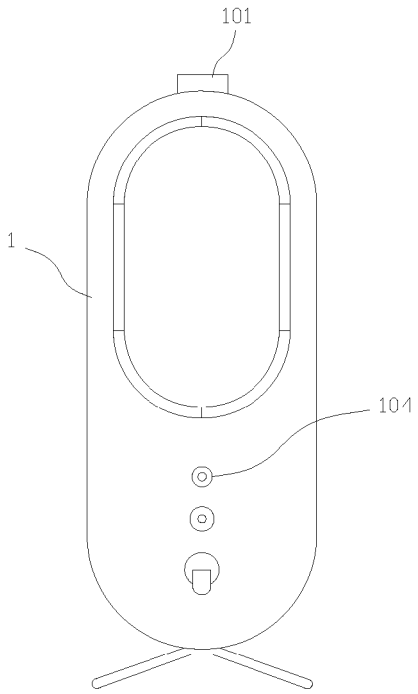
FIG. 1 is a schematic structural view of a loudspeaker enclosure according to the present invention.
Figure 4:
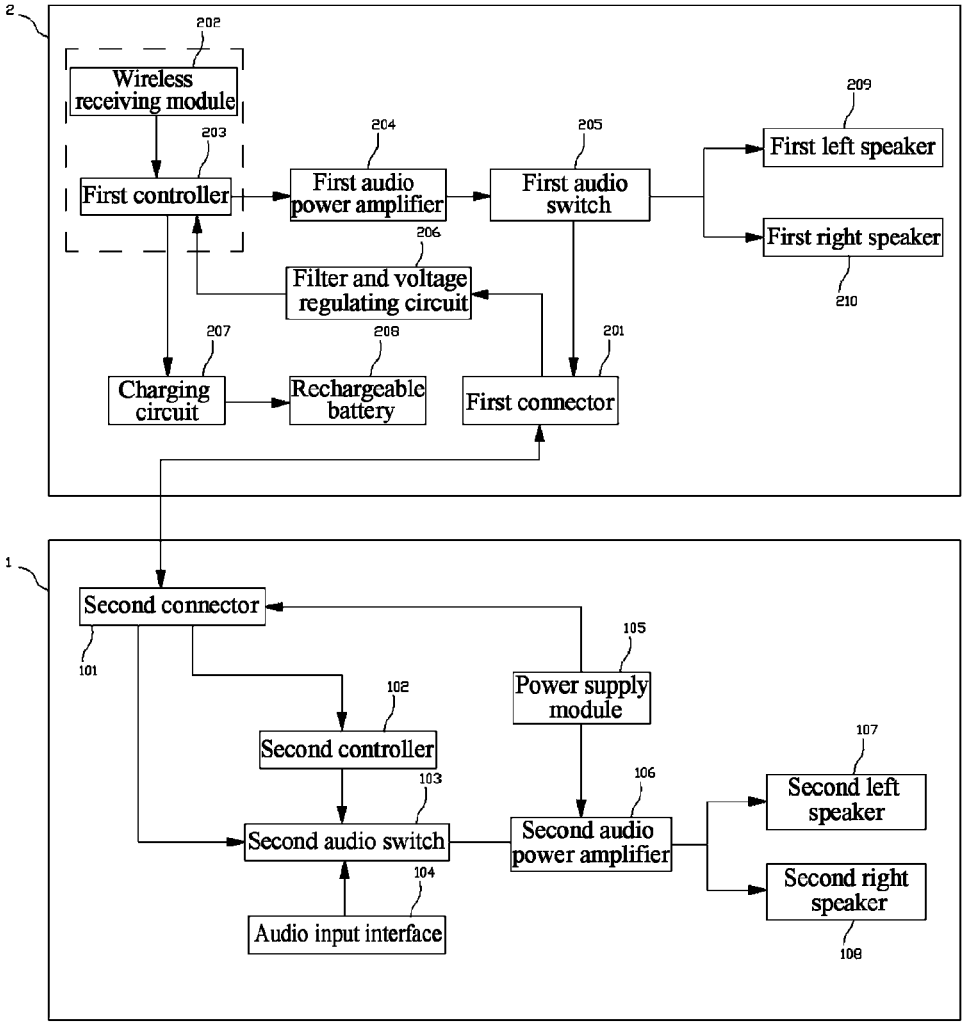
FIG. 4 is a circuit block diagram according to the present invention.

As shown in FIG. 1 and FIG. 4, a loudspeaker enclosure 1 in the present invention includes an audio input interface 104, a second audio power amplifier 106, loudspeakers, a second controller 102, a second audio switch 103, and a second connector 101. The loudspeakers include a second left speaker 107 and a second right speaker 108. The second audio switch 103, the second audio power amplifier 106, and the loudspeaker are electrically connected in sequence, that is, an audio signal output terminal of the second audio switch 103 is electrically connected to an audio signal input terminal of the second audio power amplifier 106, an audio signal output terminal of the second audio power amplifier 106 is electrically connected to the second left speaker 107 and the second right speaker 108 respectively, two audio signal input terminals of the second audio switch 103 are electrically connected to the audio input interface 104 and the second connector 101 respectively, and the second connector 101 is electrically connected to the second audio switch 103 through the second controller 102. That is, the audio signal input terminal of the second audio switch 103 is switchable between the audio input interface 104 and the second connector 101. When the audio signal input terminal of the second audio switch 103 is switched to the audio input interface 104, the audio signal input terminal of the second audio power amplifier 106 receives audio signals transmitted through the audio input interface 104. When the audio signal input terminal of the second audio switch 103 is switched to the second connector 101, the audio signal input terminal of the second audio power amplifier 106 receives audio signals transmitted by the second connector 101. The switch of the second audio switch 103 is controlled with the second controller 102. An input terminal of the second controller 102 is electrically connected to a pin of the second connector 101 and is used for receiving the voltage of the pin of the second connector 101. An output terminal of the second controller 102 is connected to the second audio switch and is used for controlling the second audio switch 103 to switch the audio signal input terminal.

Figure 2:
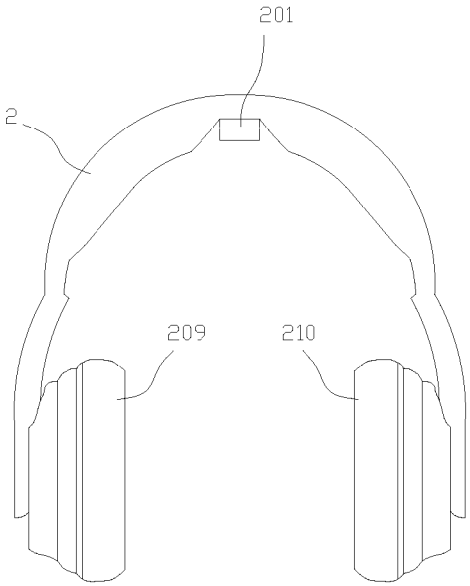
FIG. 2 is a schematic structural view of wireless headphones according to the present invention.

As shown in FIG. 2 and FIG. 4, wireless headphones 2 in the present invention include a wireless receiving module 202, a first controller 203, a first audio power amplifier 204, a first audio switch 205, a wireless headphone speaker, a filter and voltage regulating circuit 206, and a first connector 201. The wireless headphone speakers include a first left speaker 209 and a first right speaker 210. The wireless receiving module 202, the first controller 203, the first audio power amplifier 204, and the first audio switch 205 are electrically connected in sequence. That is, a data output terminal of the wireless receiving module 202 is electrically connected to an input terminal of the first controller 203, an output terminal of the first controller 203 is electrically connected to an audio signal input terminal of the first audio power amplifier 204, an audio signal output terminal of the first audio power amplifier 204 is electrically connected to an audio signal input terminal of the first audio switch 205, two audio signal output terminals of the first audio switch 205 are electrically connected to the loudspeakers and the first connector 201 respectively, and the first connector 201 is electrically connected to the first controller 203 through the filter and voltage regulating circuit 206. That is, an audio signal output terminal of the first audio switch 205 is switchable between the wireless headphone speakers and the first connector 201. When the audio signal output terminal of the first audio switch 205 is switched to the wireless headphone speakers, the audio signal output terminal of the first audio switch 205 outputs audio signals to the first left speaker 209 and the first right speaker 210. When the audio signal output terminal of the first audio switch 205 is switched to the first connector 201, the audio signal output terminal of the first audio switch 205 outputs audio signals to the first connector 201. The switch of the first audio switch 205 is controlled with the first controller 203. A voltage input terminal of the filter and voltage regulating circuit 206 is electrically connected to a pin of the first connector 201, and a voltage output terminal of the filter and voltage regulating circuit 206 is electrically connected to an input terminal of the first controller 203.

The wireless headphones 2 may receive wireless audio signals by using a Bluetooth technology or a WIFI technology, that is, the wireless receiving module 202 may be a Bluetooth module or a WIFI module, and the first controller 203 may be a built-in microprocessor on a Bluetooth chip or a WIFI chip.

Figure 3:
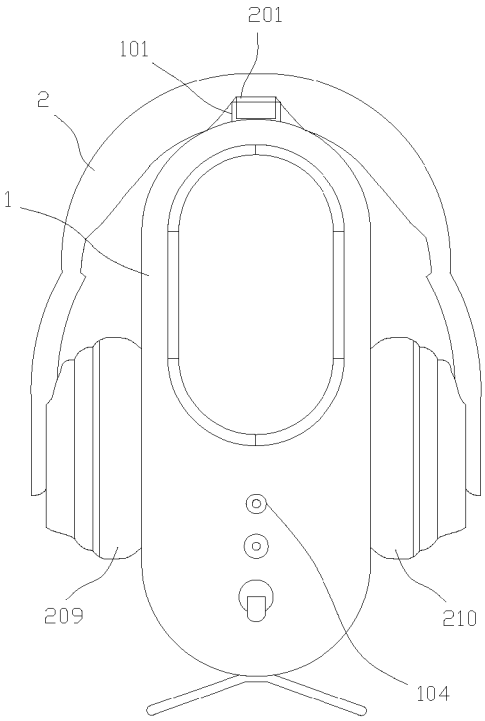
FIG. 3 is a schematic structural view when wireless headphones are placed on a loudspeaker enclosure according to the present invention.

The first connector 201 and the second connector 101 fit in a detachable electrical plug and receptacle connection. Referring to FIG. 3 and FIG. 4, in this case, the first connector 201 and the second connector 101 are plug-connected, the wireless headphones 2 are placed on the loudspeaker enclosure 1, and the wireless headphones 2 output the wireless audio signals received by the wireless receiving module 202 to the loudspeaker enclosure 1, and plays music with the second left speaker 107 and the second right speaker 108. In this case, the audio signal output terminal of the first audio switch 205 is switched to the first connector 201, and the audio signal input terminal of the second audio switch 103 is switched to the second connector 101. Because in this case, the first connector 201 and the second connector 101 are electrically plug-connected, the first connector 201 and the second connector 101 are arranged with multiple matching pins to transmit audio signals, voltage, and current, so that the wireless audio signals received by the wireless receiving module 202 is transmitted to the second left speaker 107 and the second right speaker 108 through the first controller 203, the first audio power amplifier 204, the first audio switch 205, the first connector 201, the second connector 101, the second audio switch 103, and the second audio power amplifier 106 in sequence. Referring to FIG. 1 and FIG. 2, in this case, the first connector 201 and the second connector 101 are detached, and in this case, the wireless headphones 2 and the loudspeaker enclosure 1 are detached, and the wireless headphones 2 and the loudspeaker enclosure 1 may be separately used. That is, in this case, the audio signal output terminal of the first audio switch 205 is switched to the first left speaker 209 and the first right speaker 210, and the wireless audio signals received by the wireless receiving module 202 is transmitted to the first left speaker 209 and the first right speaker 210 through the first controller 203, the first audio power amplifier 204, and the first audio switch 205 in sequence. In this case, the audio signal input terminal of the second audio switch 103 is switched to the audio input interface 104, and the output interface of a sound source output apparatus is connected to the audio input interface 104 through a data cable, so that the audio signals received through the audio input interface 104 is transmitted to the second left speaker 107 and the second right speaker 108 through the second audio switch 103 and the second audio power amplifier 106 in sequence.

When the first connector 201 and the second connector 101 are plug-connected, the voltage of the pin of the first connector 201 is output to the first controller 203 through the filter and voltage regulating circuit 206. After the voltage output to the first controller 203 through the filter and voltage regulating circuit 206 is stabilized at 5 V and 5 V lasts at least 100 milliseconds, the first controller 203 sends a signal to the first audio switch 205, and controls the switching of the audio signal output terminal of the first audio switch 205, that is, controls the audio signal output terminal of the first audio switch 205 to switch from the first left speaker 209 and the first right speaker 210 to the first connector 201. The reason why the condition that the voltage output to the first controller 203 through the filter and voltage regulating circuit 206 is stabilized at 5 V and 5 V lasts at least 100 milliseconds needs to be met is as follows: When the first connector 201 and the second connector 101 are plug-connected, the first connector 201 and the second connector 101 usually cannot obtain stable contact instantly. If the first audio switch 205 is switched before the first connector 201 and the second connector 101 have stable contact, audio signals may be transmitted intermittently between the first connector 201 and the second connector 101, thereby generating audio noise, and in this case, the voltage of the pin of the first connector 201 is unstable. After the voltage output to the first controller 203 through the filter and voltage regulating circuit 206 is stabilized at 5 V and 5 V lasts at least 100 milliseconds, it indicates that the first connector 201 and the second connector 101 have stable contact. The voltage of the pin of the first connector 201 becomes stable only after the first connector 201 and the second connector 101 have stable contact. Therefore, if it is detected that the voltage of the pin of the first connector 201 is stable, it indicates that the first connector 201 and the second connector 101 have stable contact, and in this case, the switch of the audio signal output terminal of the first audio switch 205 generates no noise.

When the first connector 201 and the second connector 101 are plug-connected, the second controller 102 checks the voltage of the grounding contact of the first connector 201. After it is detected that the voltage of the grounding contact of the first connector 201 is stabilized at zero volt and zero volt lasts at least 100 milliseconds, the second controller 102 sends a control signal to the second audio switch 103, and the audio signal input terminal of the second audio switch 103 is switched to the second connector 101. When the first connector 201 and the second connector 101 do not have stable contact, the voltage of the grounding contact of the first connector 201 cannot be stabilized at zero volt. In this case, if the audio signal input terminal of the second audio switch 103 is switched, because the first connector 201 and the second connector 101 do not have stable contact, the audio signals are intermittently transmitted between the first connector 201 and the second connector 101, thereby generating audio noise. When the first connector 201 and the second connector 101 have stable contact, the grounding contact of the first connector 201 is grounded through the second controller 102, so that the voltage of the grounding contact of the first connector 201 is stabilized at zero volt. Therefore, after it is detected that the voltage of the grounding contact of the first connector 201 is stabilized at zero volt and zero volt lasts at least 100 milliseconds, it indicates that the first connector 201 and the second connector 101 have stable contact. In this case, the switch of the audio signal input terminal of the control second audio switch 103 generates no noise.

The wireless headphones 2 further include a charging circuit 207 and a rechargeable battery 208. A current output terminal of the first controller 203 is electrically connected to the charging circuit 207 and the rechargeable battery 208 in sequence. The loudspeaker enclosure 1 further includes a power supply module 105 that is electrically connected to the second connector 102 and the second audio power amplifier 106 separately, and the power supply module 105 provides a 5-V voltage. When the first connector 201 and the second connector 101 are plug-connected, the voltage of the pin of the first connector 201 is output to the first controller 203 through the filter and voltage regulating circuit 206. After the voltage output to the first controller 203 through the filter and voltage regulating circuit 206 is stabilized at a voltage value and the voltage value lasts at least 100 milliseconds, the first controller 203 outputs a current to the charging circuit 207 to charge the rechargeable battery 208. After the first connector 201 and the second connector 101 are plug-connected, the power supply module 105 charges the rechargeable battery 208 through the second connector 101, the first connector 201, the filter and voltage regulating circuit 206, the first controller 203, and the charging circuit 207 in sequence. If the first controller 203 outputs current to charge the rechargeable battery 208 before the first connector 201 and the second connector 101 have stable contact, the first controller 203 may shut down due to the jumping of the output voltage of the first controller 203, resulting in that the shutdown of the wireless headphones 2. After the voltage output to the first controller 203 through the filter and voltage regulating circuit 206 is stabilized at a voltage value and the voltage value lasts at least 100 milliseconds, it indicates that the first connector 201 and the second connector 101 have stable contact. In this case, when the first controller 203 outputs a current to charge the rechargeable battery 208, jitter of an output voltage of the first controller 203 does not occur, thereby avoiding a case that the wireless headphones 2 fail when the first connector 201 and the second connector 101 are plug-connected.

What is claimed is:

1. A loudspeaker enclosure system having detachable wireless headphones, comprising a loudspeaker enclosure, wherein the loudspeaker enclosure comprises an audio signal input interface, a second audio power amplifier, and loudspeakers, and further comprising wireless headphones, wherein the wireless headphones comprise a wireless receiving module, a first controller, a first audio power amplifier, a first audio switch, wireless headphone speakers, a filter and voltage regulating circuit, and a first connector, wherein the wireless receiving module, the first controller, the first audio power amplifier, and the first audio switch are electrically connected in sequence, two audio signal output terminals of the first audio switch are electrically connected to the loudspeakers and the first connector respectively, and the first connector is electrically connected to the first controller through the filter and voltage regulating circuit, and the loudspeaker enclosure further comprises a second controller, a second audio switch, and a second connector, wherein the second audio switch, the second audio power amplifier, and the loudspeakers are electrically connected in sequence, two audio signal input terminals of the second audio switch are electrically connected to the audio input interface and the second connector respectively, the second connector is electrically connected to the second audio switch through the second controller, and the first connector and the second connector are detachable matching electrical plug and receptacle connections.

2. The loudspeaker enclosure system having detachable wireless headphones according to claim 1, wherein: the wireless headphones further comprise a charging circuit and a rechargeable battery, a current output terminal of the first controller is electrically connected to the charging circuit and the rechargeable battery in sequence, and the loudspeaker enclosure further comprises a power supply module that is electrically connected to the second connector and the second audio power amplifier separately.

3. The loudspeaker enclosure system having detachable wireless headphones according to claim 1, wherein:

when a first connector and a second connector are plug-connected, the voltage of a pin of the first connector is output to a first controller through a filter and voltage regulating circuit, and after the voltage output to the first controller through the filter and voltage regulating circuit is stabilized at a certain voltage value and the voltage value lasts at least 100 milliseconds, the first controller controls the audio signal output terminal of the first audio switch to switch to the first connector.

4. The loudspeaker enclosure system having detachable wireless headphones according to claim 3, wherein:

when the first connector and the second connector are plug-connected, a second controller detects the voltage of a grounding contact of the first connector, and after it is detected that the voltage of the grounding contact of the first connector is stabilized at zero volt and lasts at least 100 milliseconds, the second controller sends a control signal to a second audio switch, and an audio signal input terminal of the second audio switch is switched to the second connector.

5. The loudspeaker enclosure system having detachable wireless headphones according to claim 2, wherein:

when a first connector and a second connector are plug-connected, voltage of a pin of the first connector is output to a first controller through a filter and voltage regulating circuit, and after the voltage output to the first controller through the filter and voltage regulating circuit is stabilized at a certain voltage value and the voltage value lasts at least 100 milliseconds, the first controller outputs current to a charging circuit to charge a rechargeable battery.

6. The loudspeaker enclosure system having detachable wireless headphones according to claim 2, wherein:

when a first connector and a second connector are plug-connected, the voltage of a pin of the first connector is output to a first controller through a filter and voltage regulating circuit, and after the voltage output to the first controller through the filter and voltage regulating circuit is stabilized at a certain voltage value and the voltage value lasts at least 100 milliseconds, the first controller controls the audio signal output terminal of the first audio switch to switch to the first connector.

* * * * *